United States Patent [19]

Bollinger, Sr.

[11] 3,990,184

[45] Nov. 9, 1976

[54] PLUG DOOR OPERATING APPARATUS

[75] Inventor: Luther L. Bollinger, Sr., Reading, Pa.

[73] Assignee: Hennessy Products, Incorporated, Chambersburg, Pa.

[22] Filed: Apr. 21, 1975

[21] Appl. No.: 570,209

[52] U.S. Cl. ..... 49/218; 49/360; 49/363

[51] Int. Cl.[2] ..... E05D 15/10

[58] Field of Search ..... 49/360–363, 49/220, 218

[56] References Cited

UNITED STATES PATENTS

| | | | |
|---|---|---|---|
| 3,453,778 | 7/1969 | Daugirdas | 49/363 X |
| 3,653,153 | 4/1972 | Nagy | 49/220 |
| 3,802,125 | 4/1974 | Baker | 49/360 |
| 3,883,992 | 5/1975 | Bollinger | 49/362 |

*Primary Examiner*—Kenneth Downey
*Attorney, Agent, or Firm*—Bedell and Burgess

[57] ABSTRACT

Apparatus for operating sliding plug-type railway car doors, of the type in which the front end of the door track is curved toward the car side, the front portion of the door is mounted directly on a track-mounted carriage, and the rear portion of the door is mounted via cranks on a track-mounted carriage, comprises longitudinally movable rack and pinion means on the car side adjacent the door, and mechanism on the door, actuable by longitudinal movement of the rack and pinion means for unlocking the door, rotating the door mounting cranks to swing the rear edge of the door in and out of the door opening, and moving the door longitudinally of the car into and out of registry with the door opening therein.

12 Claims, 20 Drawing Figures

PLUG DOOR OPERATING APPARATUS

BACKGROUND OF THE INVENTION:

1. Field of the Invention

The invention relates to door structures, and particularly to apparatus for unlocking, opening, closing and locking plug doors of railway house cars.

2. The Prior Art

The prior art includes railway car plug doors of the type in which the front end of the door track curves from an outwardly spaced portion parallel to the car side toward the car side near the front edge of the door opening, with the front portion of the door directly mounted on a track-mounted carriage and the rear portion of the door mounted by means of a crank on a track-mounted carriage for movement into and out of the door opening by direct manual rotation of the crank mounting shaft and manual sliding of the door along the car side between open and closed positions. The prior art also includes car door structures in which longitudinal racks are mounted on the car side and manually actuated pinion driven gear boxes are mounted on the racks and connected to the door for moving it longitudinally of the car side.

SUMMARY OF THE INVENTION

The invention provides common means responsive to selective movements lengthwise of a railway car plug door for sequentially moving the door transversely of the car side in and out of the door opening and longitudinally of the car between positions in and out of registry with the car door opening.

It further utilizes the same means for sequentially unlocking the car door prior to transverse outward movement of the door and locking the car door subsequent to inward movement of the car door.

It provides a manually actuated device mounted on the car side for applying desired longitudinal movement to the door operating means and thereby moving the entire door lengthwise of the car between positions in and out of registry with the door opening.

The invention provides means for operating a sliding plug door on a railway house car wherein the entire operation of unlocking the door, moving it transversely out of the door opening, moving it longitudinally of the car to and from open position, movement transversely of the car into the opening, and locking it are accomplished by manipulation of a single handwheel.

BRIEF DESCRIPTION OF THE DRAWINGS

FIG. 6 is an enlarged side elevational view of the operating mechanism and adjacent portions of the door and car wall showing the mechanism in the door-closed and locked position corresponding to FIGS. 1 and 2.

FIG. 7 is an enlarged plan view corresponding to FIG. 6.

FIG. 8 is an enlarged side elevational view of the operating mechanism and adjacent portions of the car door and wall showing the mechanism in the door-closed but unlocked position.

FIG. 9 is an enlarged plan view corresponding to FIG. 8.

FIG. 10 is an enlarged side elevational view of the mechanism and adjacent parts of the car door and side with the rear door edge moved outwardly from the car side.

FIG. 11 is an enlarged plan view corresponding to FIG. 10.

FIG. 12 is a side elevational view of the mechanism and adjacent parts of the door during rearward movement of the door.

FIG. 13 is an enlarged plan view corresponding to FIG. 12.

FIG. 14 is an enlarged side elevational view of the mechanism during forward movement of the door toward closed position.

FIG. 15 is an enlarged plan view corresponding to FIG. 14.

FIG. 16 is an enlarged side elevational view of the mechanism and adjacent parts of the door during transverse movement of the rear edge of the door into the opening.

FIG. 17 is an enlarged plan view corresponding to FIG. 16.

DETAILED DESCRIPTION OF THE INVENTION

Figure 1:
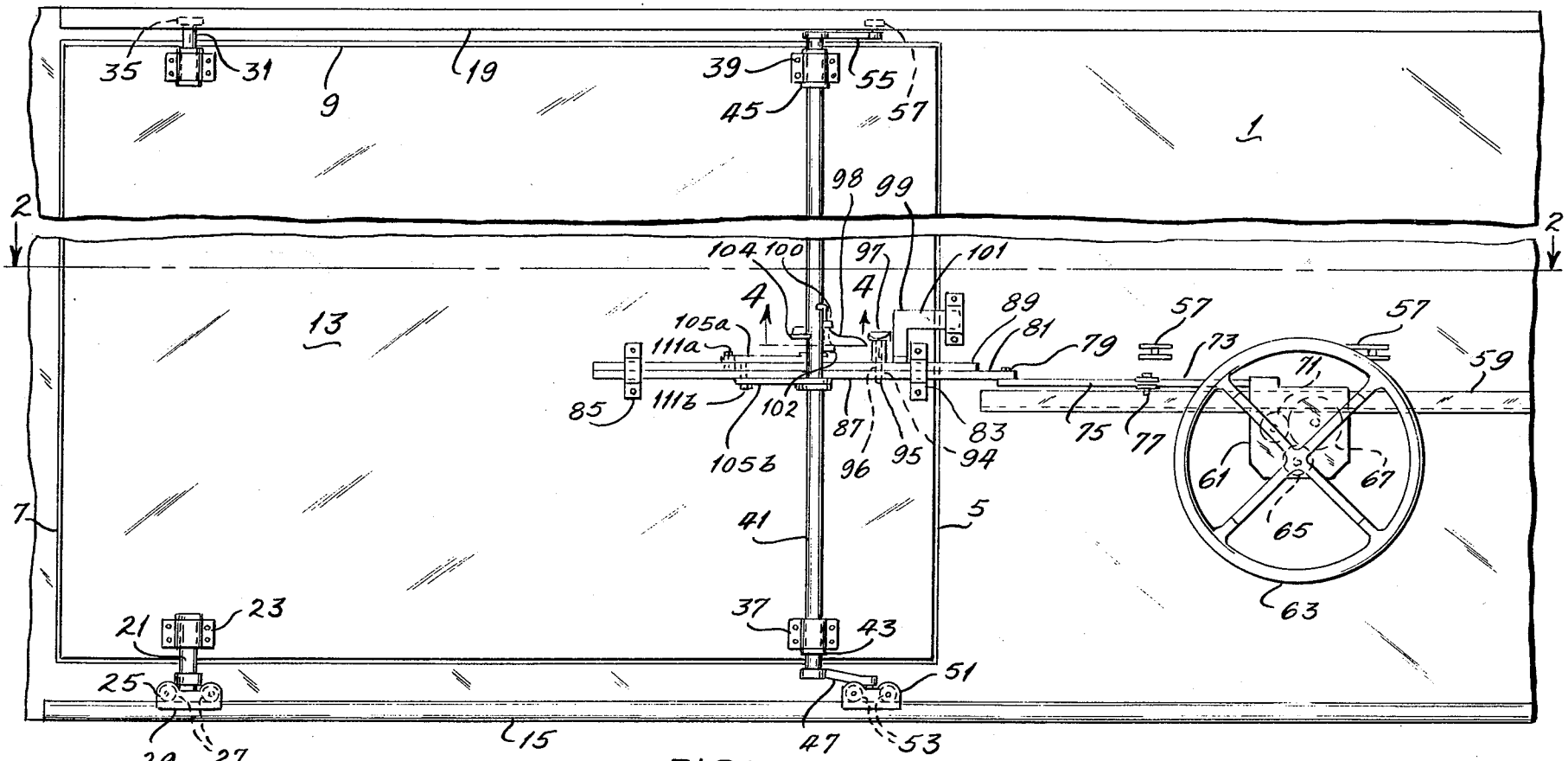
FIG. 1 is a partial side elevational view of a railway house car showing the door closed and door operating mechanism embodying the invention in door-closed and locked position.
Figure 2:
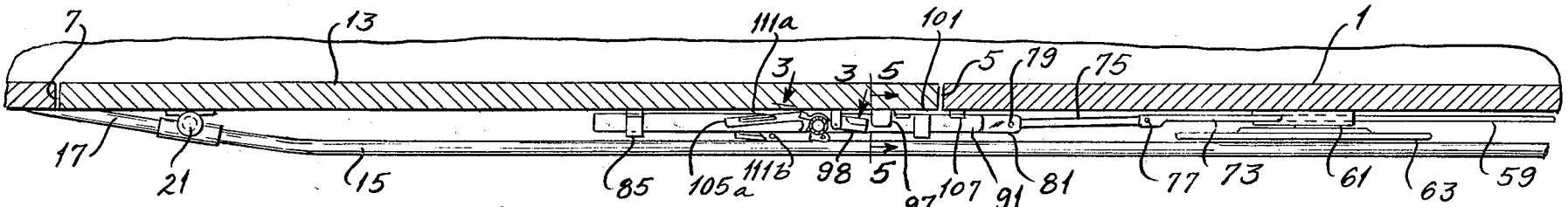
FIG. 2 is a horizontal sectional view taken along line 2—2 of FIG. 1.
Figure 2A:
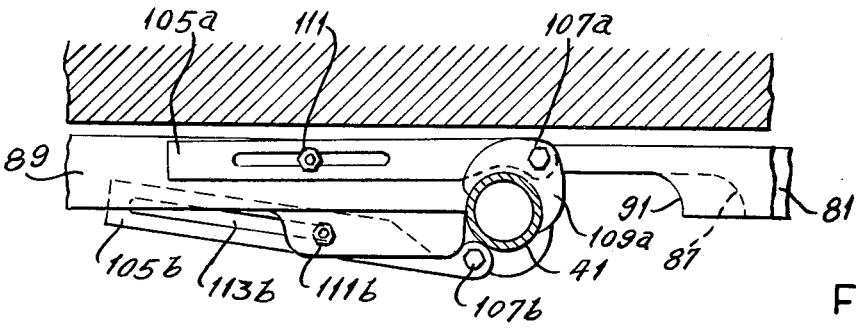
FIGS. 2A, 2B and 2C are enlarged horizontal sectional views taken respectively along lines 2A—2A, 2B—2B and 2C—2C of FIG. 6.
Figure 2B:
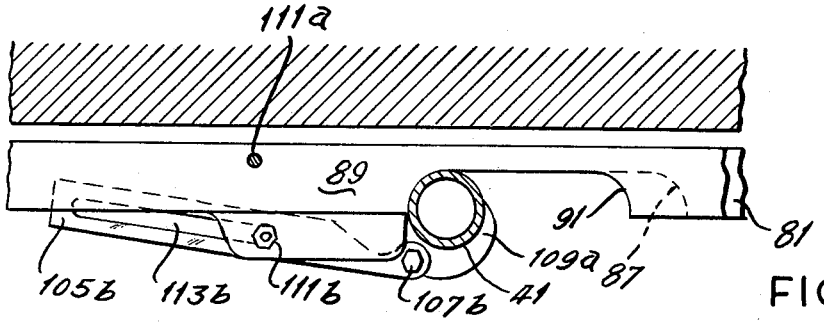
Figure 2C:
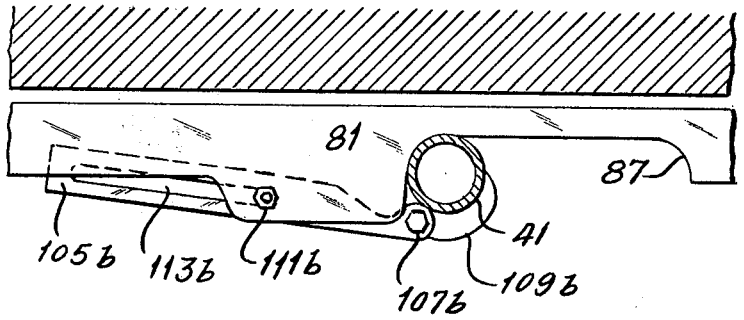
Figure 3:
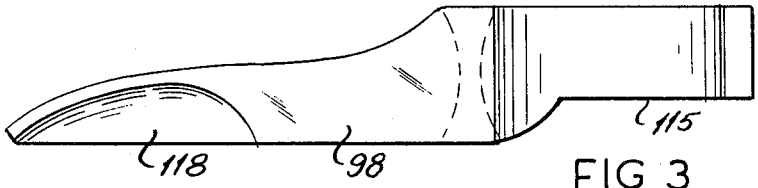
FIGS. 3–5 respectively are inboard side elevation, and bottom views of the cam lever taken along lines 3—3 and 4—4 of FIGS. 1 and 2, and a front view of the cam taken along line 5—5 of FIG. 2.
Figure 4:
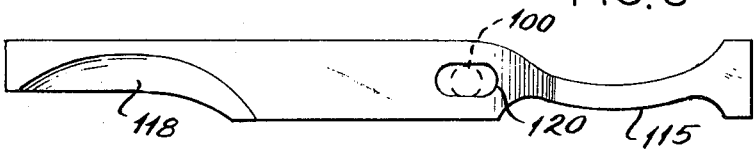

The numeral 1 denotes a railway house car side wall having a rectangular door opening 3 therein defined by rear and front vertical edges 5 and 7 respectively and the car side plate and threshold 9 and 11 respectively.

A door 13 is received in the door opening when closed, with its outer surface flush with the outer surface of car side wall 1.

A horizontal track 15 is secured to car side wall 1 below the door opening with its front end portion 17 tapering outwardly from the car side wall and the remainder of the track rearwardly thereof being uniformly spaced outwardly from the car side wall in parallel relation therewith throughout its length, and above the door opening a downwardly open channel-shaped door retainer rail 19 is secured to the car side plate 9 and similarly tapered and spaced from the car side.

For supporting door 13 on the car side so that during opening movements it moves transversely out of opening 3 and longitudinally rearwardly therefrom, a short vertical stub shaft 21 is rotatably mounted in a bearing 23 on the front portion of the car door near its lower edge, and a roller carriage 25 rotatably mounts a pair of rollers 27 resting on track 15 and has sides 29 depending below rollers 27 to guidably engage the sides of track 15.

Adjacent the top of door 13 a similar upwardly extending stub shaft 31, rotatably mounted in a bearing 33 on door 13 in axial alignment with shaft 21, mounts at its upper end a roller 35 engaging the inner surfaces of door retainer rail 19.

Adjacent the rear edge of the door and in longitudinally spaced relation therewith the door mounts a pair of bearings 37 and 39 near its bottom and top edges respectively and a vertical shaft 41 is rotatably journaled in bearings 37 and 39 and projects therefrom below and above the door. Thrust collars 43 and 45 on shaft 41 underlyingly engage bearings 37 and 39 respectively.

At its lower end shaft 41 mounts rearwardly extending bottom operating crank 47 which extends parallel to the car side when the door is closed and is pivotally supported at 49 on a roller carriage 51, rotatably mounting rollers 53 resting on track 15, the sides 53 of carriage 51 depending below the top of track 15 and guidably engaging the sides thereof.

At its upper end shaft 41 mounts rearwardly extending top operating crank 55 on the outer end of which is journaled roller 57, which is received between the inner vertical surfaces of door retainer rail 19.

From the foregoing it will be evident that the door can be opened by rotating shaft 41 counterclockwise 90°, thereby moving cranks 47 and 55 from the closed-door position parallel to the car side wall to an open-door position normal to the car side wall and thus causing the rear end of the door to move transversely out of the opening, and then moving the entire door rearwardly. As front carriage 25 and front retainer roller follow the outwardly tapered front end 17 of track 15 and the similarly tapered front end of retainer rail 19, the front end of the door moves outwardly until the door and car side are in parallel spaced relation with each other, and thence along the car side wall. A series of spacing rollers 57, journaled on vertical axes in brackets mounted on the car wall rearwardly of the door, are engageable with the inner surface of the door to prevent frictional engagement between the door and car side wall during opening and closing movements.

For effecting opening and closing movements of the door, a downwardly facing horizontal rack 59 is secured to side wall 1 rearwardly of door opening 5 and a gear box 61 is slidably mounted on top of rack 59. Gear box 61 rotatably mounts a handwheel 63 and contains reduction gearing drivingly connecting handwheel 63 to rack-engaging driving pinion 69. An idler pinion 71 spaced longitudinally of the gear box from driving pinion 69 cooperates with the latter to stabilize the gear box against tilting lengthwise of rack 59.

For transmitting movements of gear box 61 on rack 59 to door 13, the gear box mounts a forwardly extending link 73 and a connecting link 75 is pivotally connected at its rear end at 77 to link 73 and at its front end at 79 to the rear end of elongated lower travel bar 81 slidably mounted in spaced brackets 83 and 85 on door 13 and forming the input element of the door operating mechanism, the function of which is to rotate operating shaft 41 in the desired direction, lock and unlock the door and transmit longitudinal movements of gear box 61 directly to the door.

Intermediate its ends, lower travel bar 81 is formed with an elongated recess 87 to accommodate operating shaft 41 and permit the portion of bar 81 narrowed thereby to pass between the rear of shaft 41 and the front surface of door 13.

An upper travel bar 89 is slidably mounted on top of lower travel bar 81 and similarly extends through brackets 83 and 85 and is similarly formed with an elongated recess 91 to permit the portion narrowed thereby to pass between shaft 41 and the door surface.

For transmitting longitudinal movements from lower travel bar 81 to upper travel bar 89 under most conditions, an upstanding tubular guide 93 on upper travel bar 89, between shaft 41 and bracket 83, slidably mounts a pin 95 extending downwardly through aligned holes 94 and 96 in bars 81 and 89, the head of pin 95 being formed as a cam 97 normally resting on the top of guide 93. Cam 97 is rectangular in plan, with its top surface curving gradually downwardly toward its outboard side and toward its front end and with its bottom surface curving upwardly toward its front end. For actuating cam 97 and thereby raising pin 95 out of locking reception in hole 94 under certain conditions, a cam lever 98 is fulcrumed on a vertical axis pivot member 100 between brackets 102 protruding from door 13 just rearwardly of operating shaft 41. The front end of lever 98 extends between operating shaft 41 and the door surface and terminates forwardly of operating shaft 41 which mounts a lever actuating arm 104 engaging the outer surface of the front end of cam lever 98 to hold the rear end of the cam lever, which is outwardly narrowed, outward of the door surface a sufficient distance to clear cam 97.

For locking the rear edge of the door in the door opening, an L-shaped locking member is fixed to upper travel bar 89 by the base of its upstanding leg 99 and has a horizontal leg 101 projecting rearwardly beyond the rear edge of the door into a keeper 103 on side wall 1 rearwardly of rear edge 5 of the door opening.

For rotating shaft 41 counterclockwise so as to move the rear portion of door 13 transversely out of the opening, a door-opening actuating link **105*a* is positioned above upper travel bar 89 and is connected pivotally at one end at 107*a* to a collar 109*a* on shaft 41 and at its other end to upper travel bar 89 by a pivot member 111*a* mounted on bar 89 and passing through a lost-motion slot 113 in link 105*a***.

For rotating shaft 41 clockwise when the door is open and thereby moving the rear edge of the door into the door recess, a door-closing actuating link **105*b* is positioned below lower travel bar 81 and is connected at one end at 107*b* to a collar 109*b* on shaft 41 and at its other end to lower travel bar 81 by a pivot member 111*b* mounted on lower travel bar 81 and passing through a lost-motion slot 113*b***.

Figure 8:
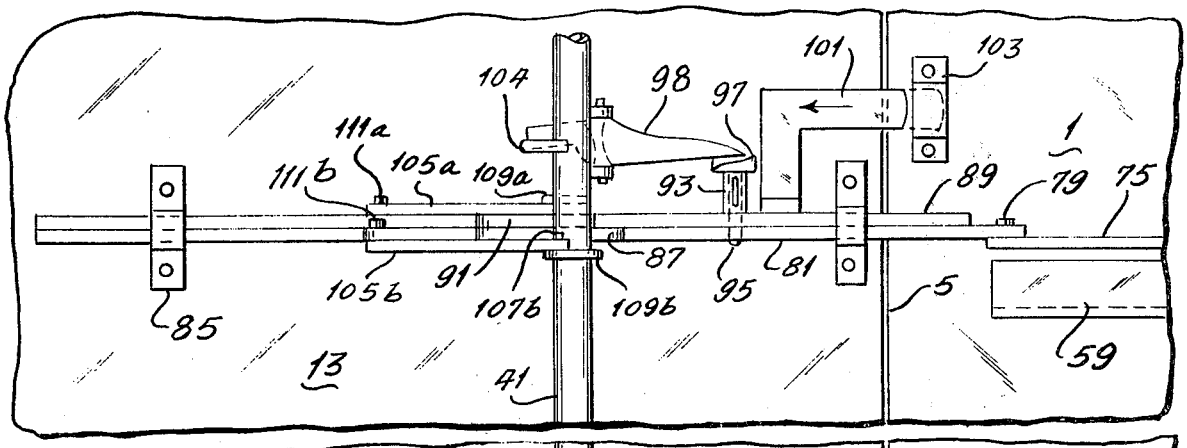
Figure 8:
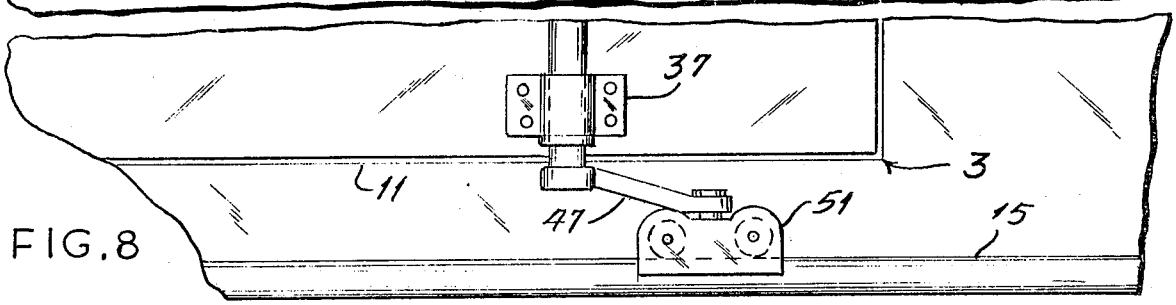
Figure 7:
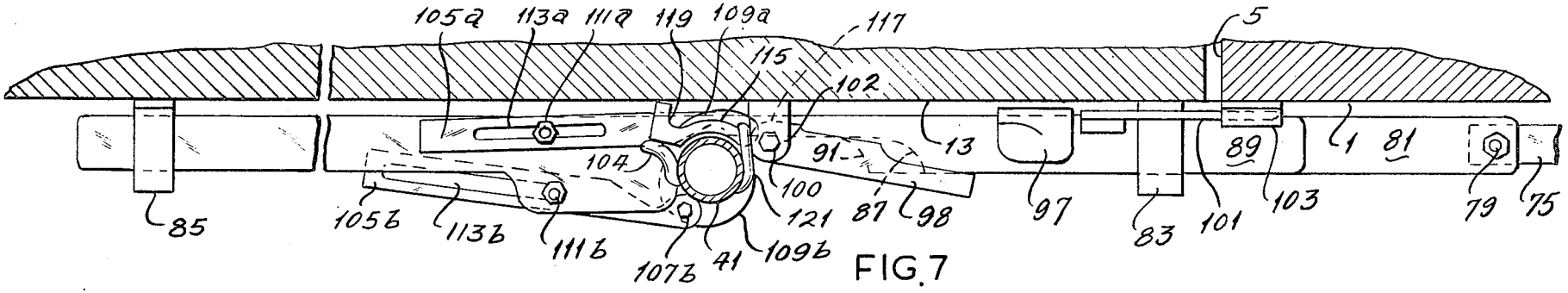
Figure 9:
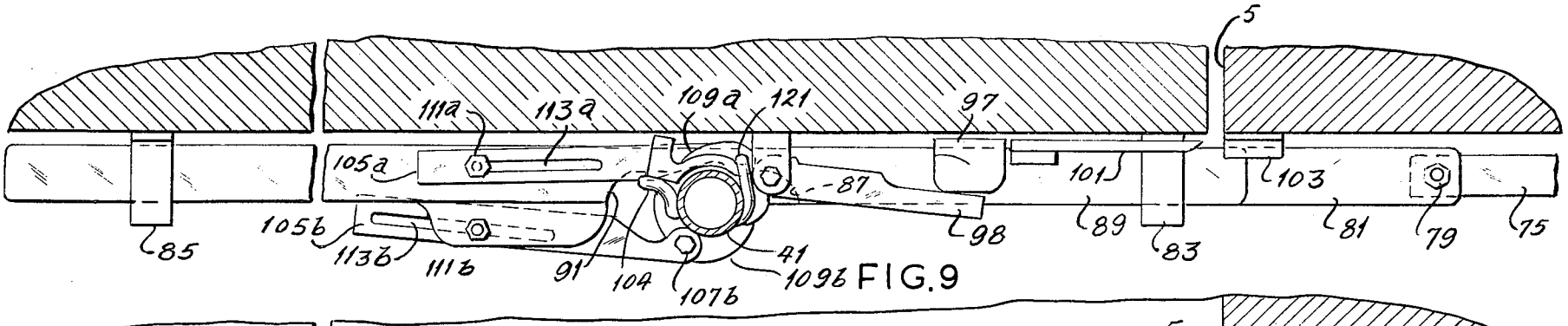

From the foregoing it will be seen that if handwheel 63 is rotated clockwise, pinion 69 will rotate counterclockwise causing gear box 61 to move forward on rack 59 and causing, through links 73 and 75, a corresponding forward movement of lower travel bar 81 from its position shown in FIGS. 1, 2, 6 and 7. Because of the engagement of pin 95 with aligned holes 94 and 96, the movement of lower travel bar 81 causes a corresponding forward movement of upper travel bar 89 to the position shown in FIGS. 8 and 9, in which lock horizontal leg 101 has been retracted from keeper 103 to a position substantially flush with the rear edge of door 13, pin 95 and cam 97 have moved forward until cam 97 is abreast of the rear end of, but below the inner surface of lever 98 and the door surface, and pivot connection **111*a* on upper travel bar 89 has moved forward to the front end of slot 113*a* in door-opening actuating link 105*a***.

Further clockwise movement of handwheel 63 causes forward movement of both travel bars and pivot member **111*a* on upper travel bar 89 to pull link 105*a* forwardly, causing counterclockwise movement of shaft 41 and similar movement of mounting crank 47 and retaining crank 55 until both of the latter assume a position substantially normal to the car side whereby the rear edge of the door is shifted transversely outwardly. The inner surface of cam lever 98 abreast of shaft 41 is formed with a recess having an arcuate surface 115 and having shoulders 117 and 119 at its respective rear and front ends, and a second lever actuating arm 121 on shaft 41 has a depending end portion extending into the lever recess engageable with lever rear shoulder 117 while the door is closed and movable about the arcuate surface during initial rotation of shaft 41 toward door-open position. During final rotation of shaft 41 to the position of FIGS. 10 and 11, actuating arm 121 engages surface 115 causing lever 98 to swing counterclockwise toward the door surface, with its bottom surface, which is formed near its rear end with an inwardly open concavity 118, riding on the sloping top surface of cam 97. To permit the rear end of cam lever 98 to rise sufficiently to override cam 97, its fulcrum pin hole 120 is widened lengthwise of the lever at top and bottom. At the same time, forward movement of lower travel bar 81 causes pivot member 111***b* to move forward in lost-motion slot 113*b* and hence caused no corresponding movement of shaft-closing actuating link 105*b*.

Figure 11:
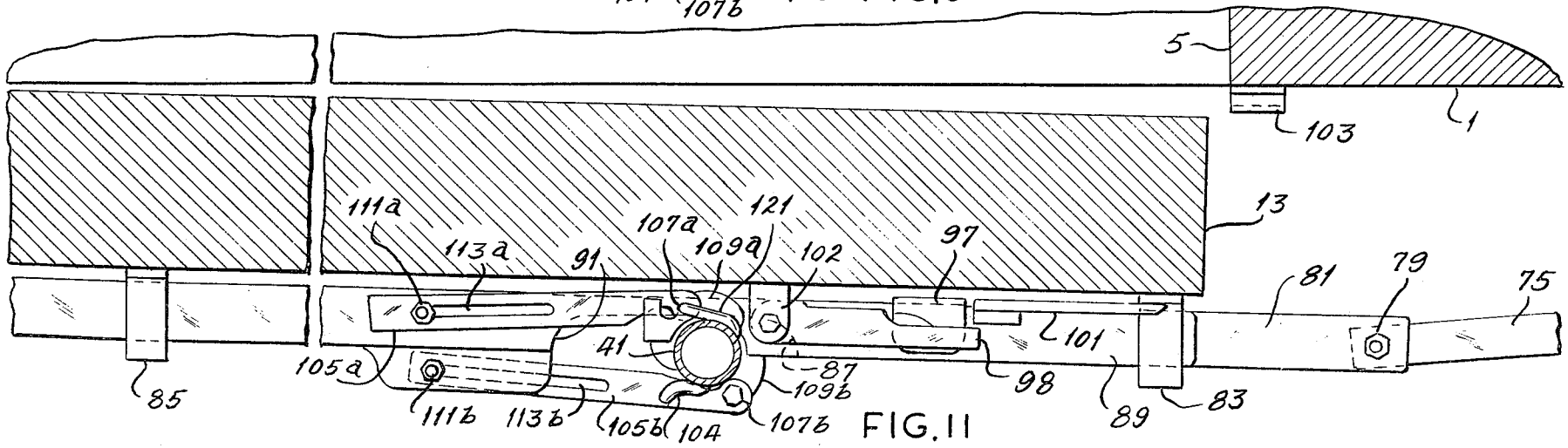
Figure 10:
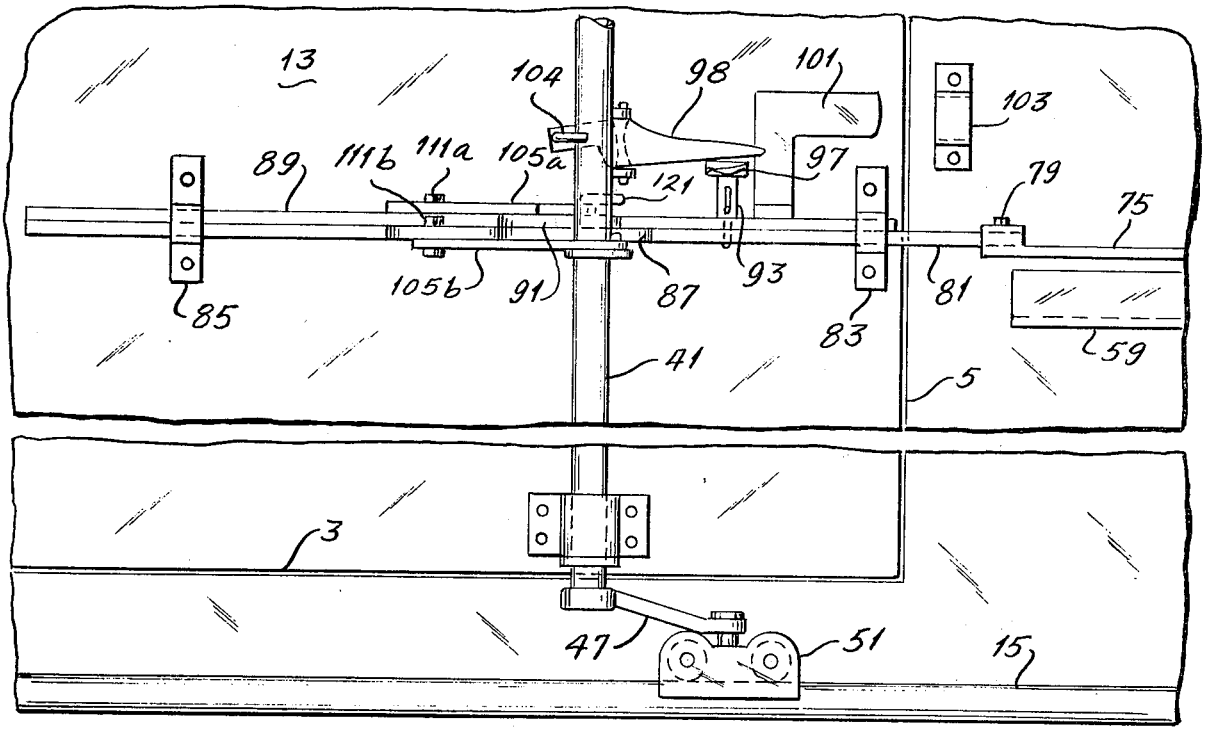

As soon as the mechanism has reached the position shown in FIGS. 10 and 11, in which the rear edge of the door is fully displaced transversely outwardly of the adjacent edge of the car side, handwheel 63 is reversed and rotated counterclockwise, causing gear box 61 and links 73 and 75 to move rearwardly and pulling travel bars 81 and 89, coupled by pin 95, rearwardly without initially causing any rearward movement of the door until the shoulders forming the front ends of recesses 87 and 91 in travel bars 81 and 89 abut the forward side of shaft 41. The rearward movement of the travel bars causes cam 98 to move rearwardly from under lever 97, which drops to its normal level and causes pivot elments 111*a* and 111*b* to move rearwardly in lost-motion slots 113*a* and 113*b* in the respective shaft actuating links 105*a* and 105*b* without moving either of the shaft actuating links or changing the position of shaft 41. Continued clockwise movement of handwheel 63 causes gear box 61 to move rearwardly along rack 59, pulling travel bars 81 and 89 rearwardly and, through their abutting engagement with the forwardly facing surface of shaft 61, pulling the entire door 13 along track 15, the front edge of the door following the bent portion of track 15 and top retainer 19 out of the recess until the entire door is parallel with the car side and thereafter until the door is completely clear of the door opening.

Figure 12:
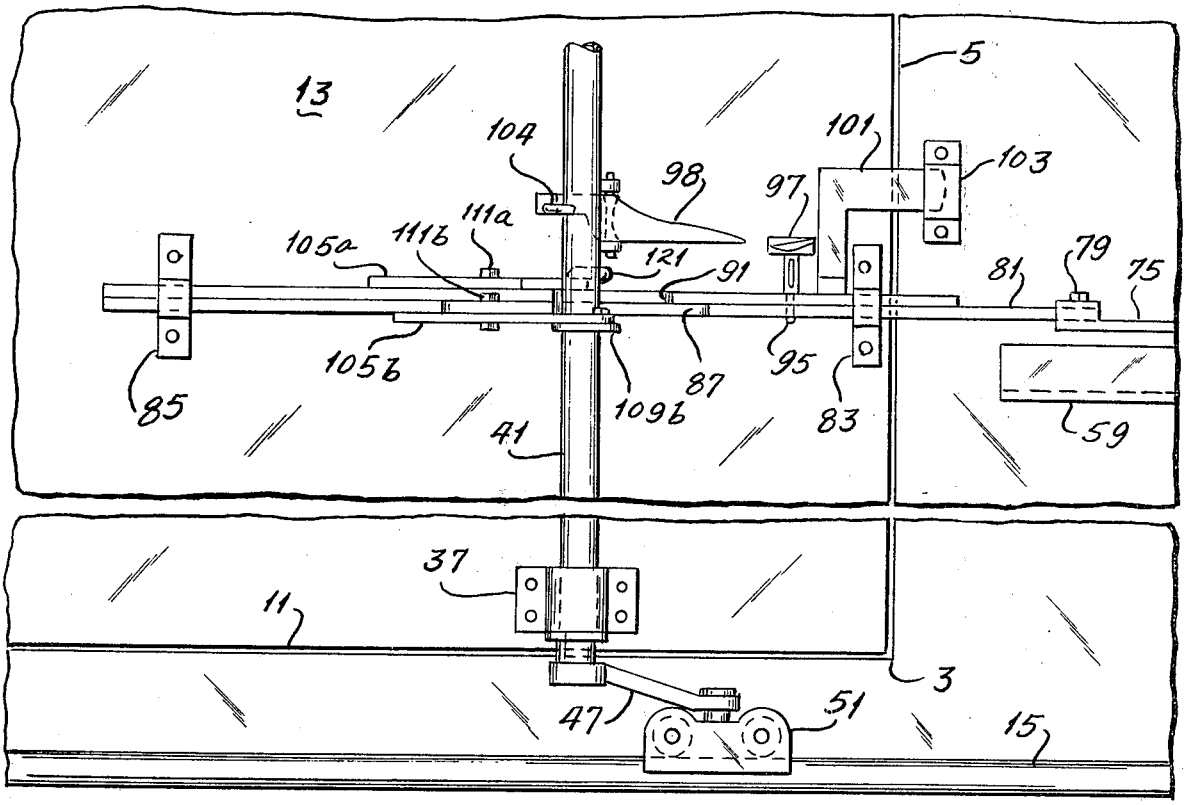
Figures 13, 15, 17:
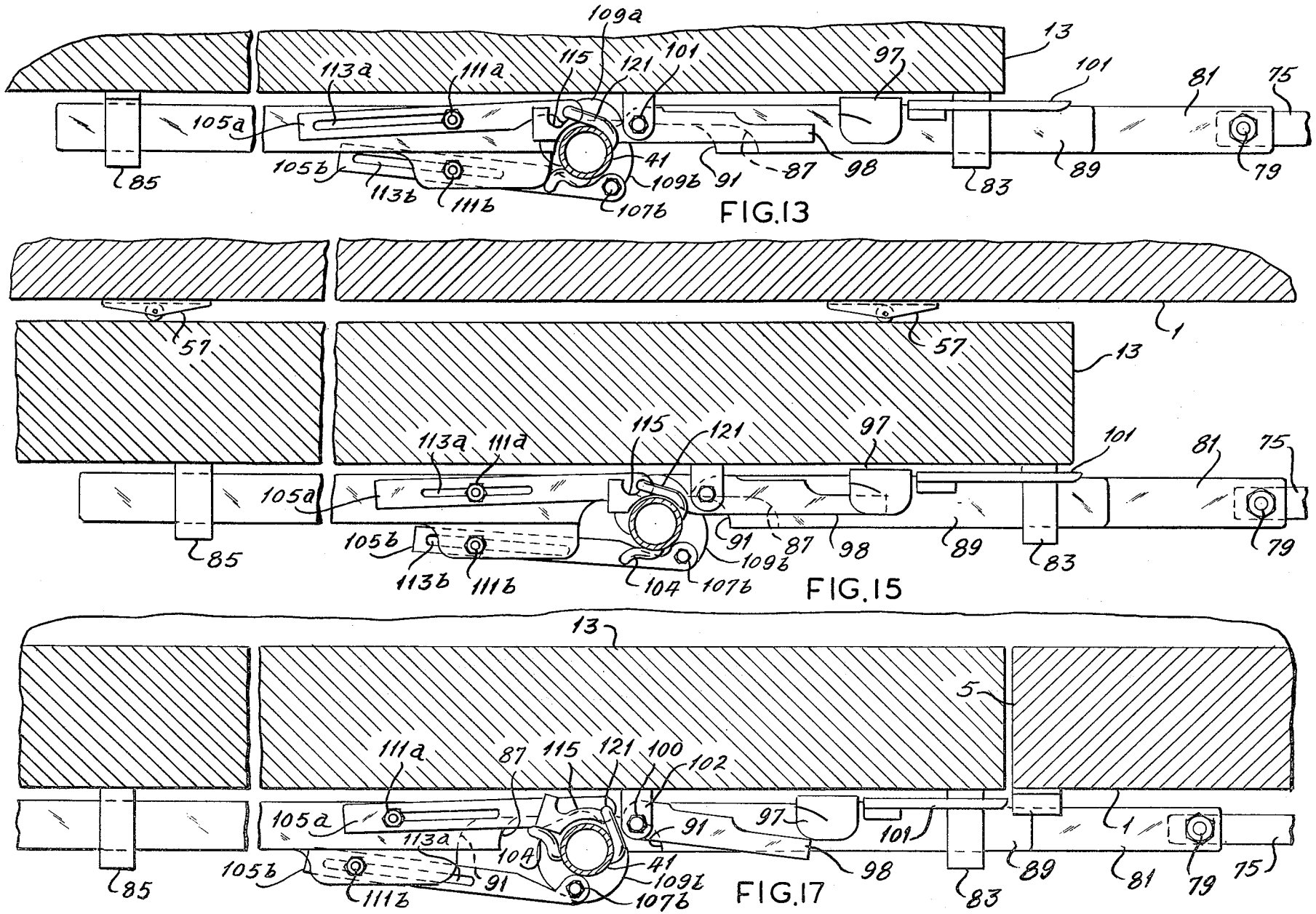
FIGS. 14–17 illustrate the door-closing sequence as follows.

The elements of the mechanism remain in the position shown in FIGS. 12 and 13 as long as the door remains fully open.

Figure 14:
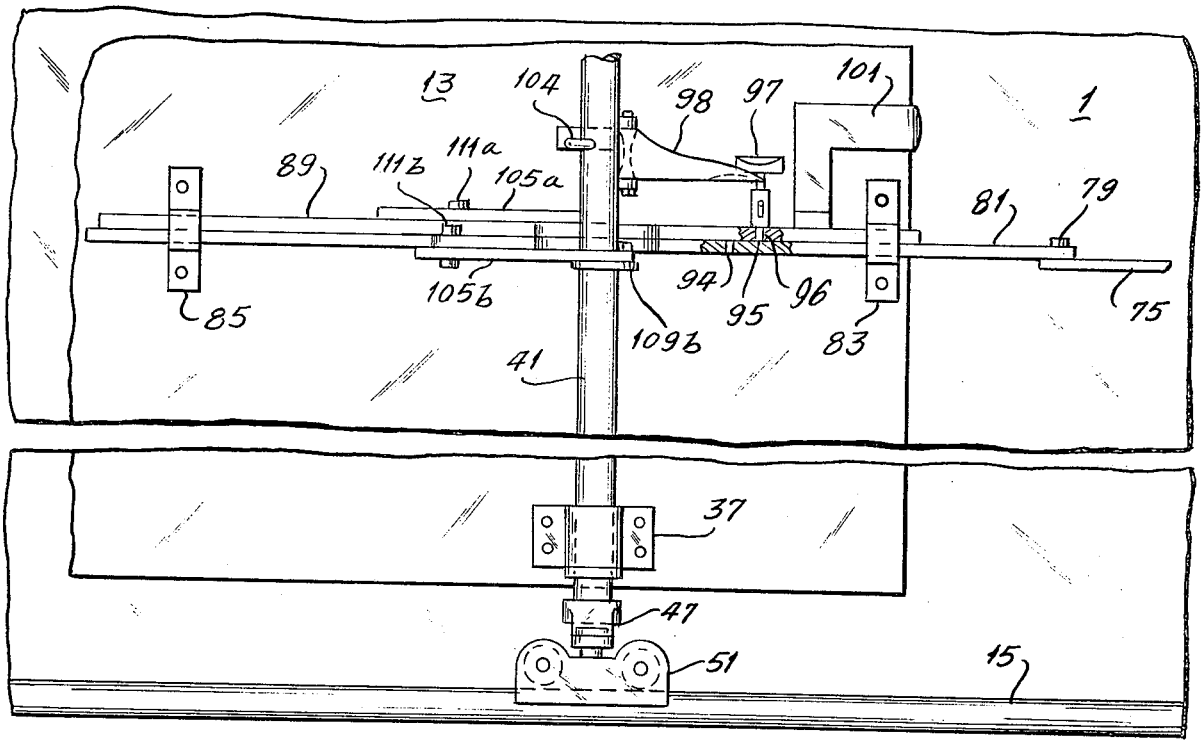

When it is desired to close the door, handwheel 63 is rotated counterclockwise causing forward movement of gear box 61 and thereby causing links 73 and 75 to push on lower travel bar 81 and initially move it and upper travel bar 89 forward relative to the door until the travel bars reach the position shown in FIGS. 14 and 15 wherein the top surface of the rear end of cam lever 98 which tapers downwardly has engaged the underside of locking pin cam 97, lifting the latter and the attached locking pin out of hole 94 in lower travel bar 81, and permitting continued forward movement of the lower travel bar relative to the door until the shoulder defining the rear end of lower travel bar recess 87 engages shaft 41 without causing further forward movement of the upper travel bar. Further forward movement of lower travel bar 81 causes corresponding forward movement of the door toward door opening 3 in the car side wall. Movement of both bars to this point did not affect the longitudinal positions of links 105*a* and 105*b* because corresponding movement of pivot elements 111*a* and 111*b* has taken place in lost-motion slots 113*a* and 113*b* in the respective shaft actuating links 105*a* and 105*b*.

Figure 16:
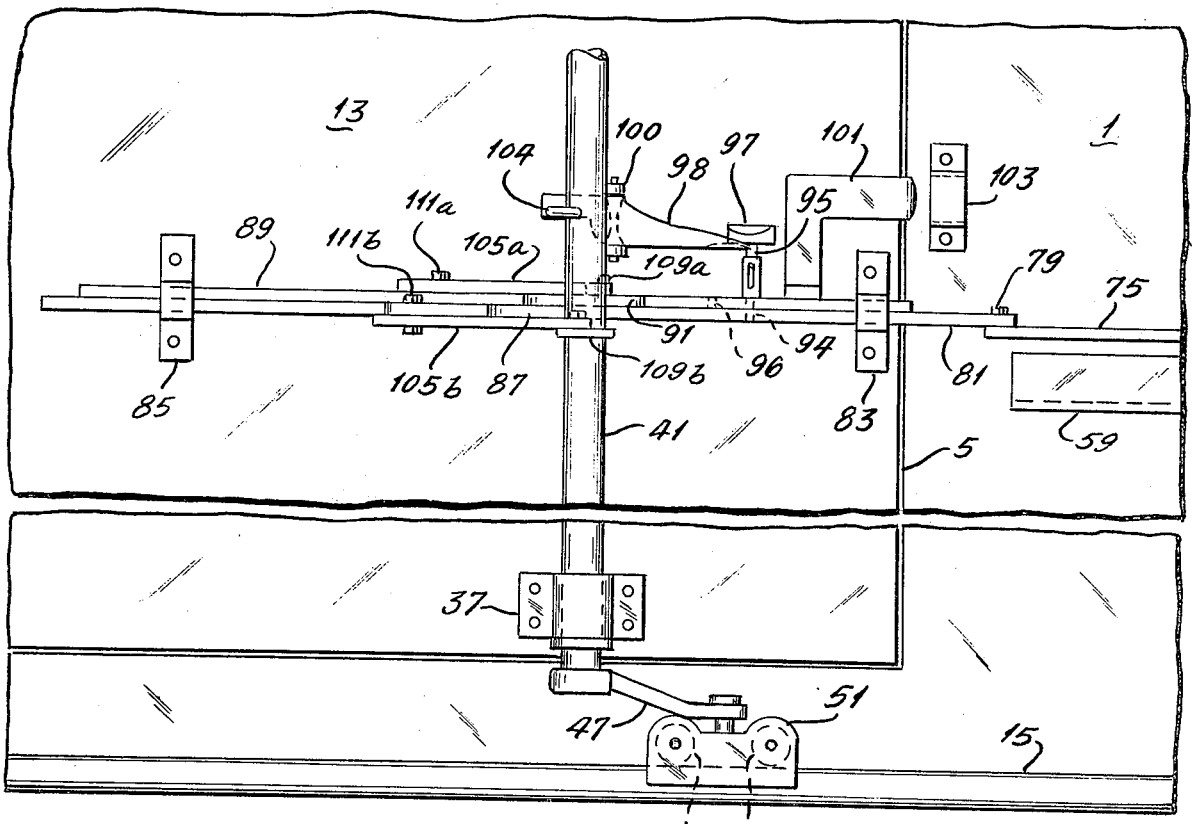
Figure 1:
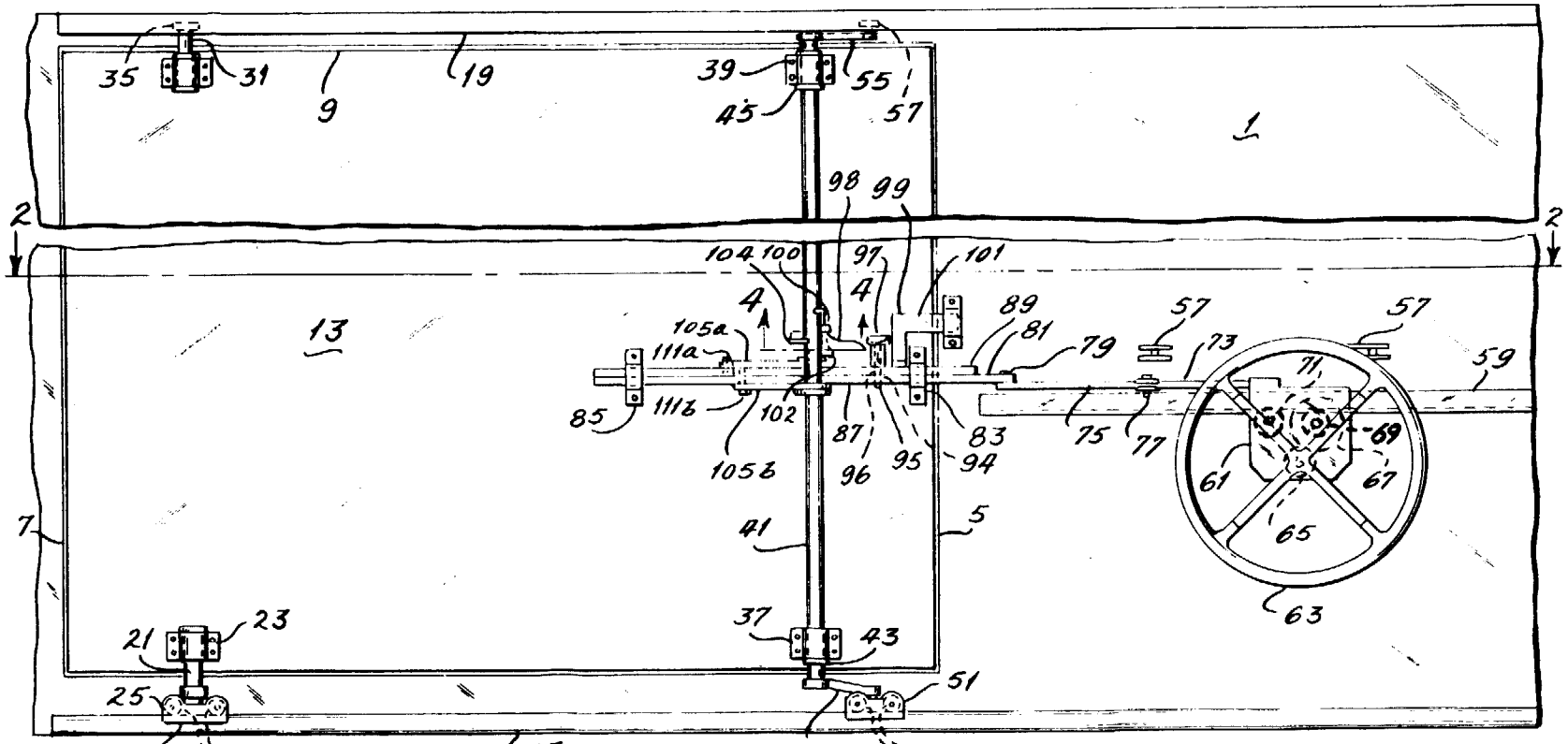

Continued counterclockwise movement of handwheel 63 after the front edge of the door enters the door opening and engages front edge 7 thereof causes lower travel bar 81 to move to the position shown in FIGS. 16 and 17, wherein pivot element 111*b* has engaged the front end of lost-motion slot 113*b* in door-closing actuating link 105*b*, causing link 105*b* to move forwardly and through pivot element 107*b* and collar 109*b* rotate shaft 41 clockwise, thereby swinging bottom and top cranks 47 and 55 to a position of parallelism with the car side, and thus causing the rear edge of the door to move transversely of the car side into the door opening. Meanwhile, as shaft 41 rotated clockwise, cam lever actuating arm 104 engaged the outer surface of the front end of lever 98, causing it to move clockwise, with its rear end swinging outwardly from the car side away from its underlying engagement with locking pin cam 97. By then rotating handwheel 63 clockwise, lower travel bar 81 is pulled rearward until its locking pin hole 94 is in registry with locking pin 95, which, unrestricted by lever 98, drops into hole 94, so that continued rearward movement of lower travel bar 81 causes similar rearward movement of upper travel bar 89 and of locking member 99, 101 with horizontal arm 101 thereof entering into locking engagement with keeper 103 on the car side until rearward movement ceases, with the parts in the position shown in FIGS. 1, 2, 6 and 7.

Figure 5:
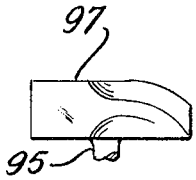
Figure 6:
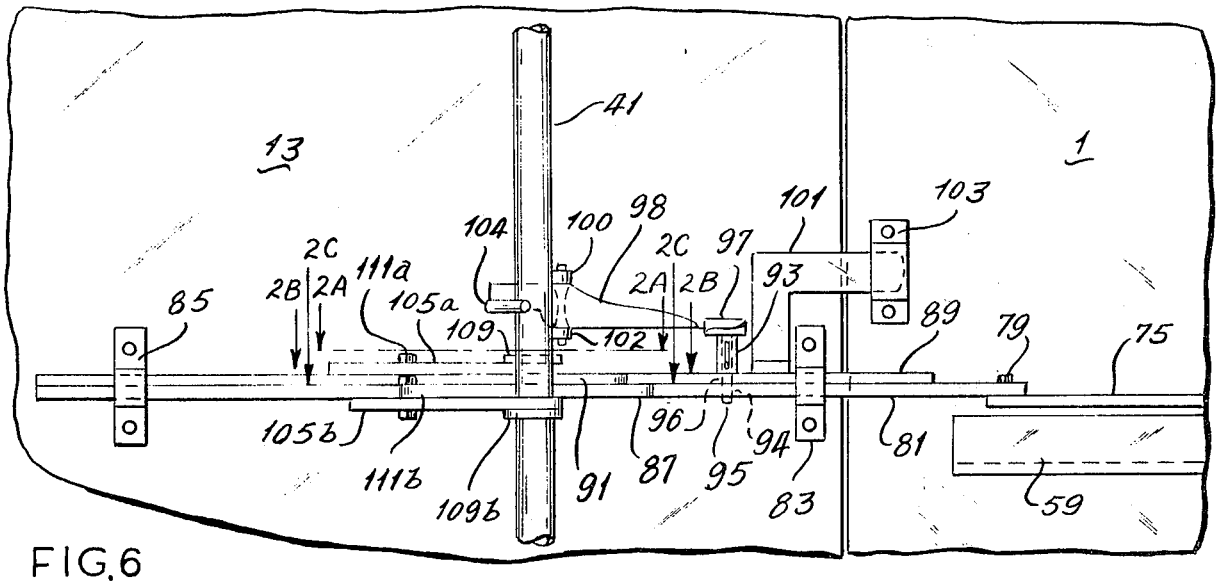
FIGS. 6–13 illustrate the door-opening sequence as follows.

Operation of the device is as follows: With the door in closed and locked position as shown in FIGS. 1, 2, 6, 7 to open the door, handwheel 63 is initially manually rotated clockwise, causing forward movement of gear box 61 and, through links 73 and 75, corresponding forward movement of lower travel bar 81 and, through pin 95, of upper travel bar 89 through brackets 83 and 85 on the car door without moving the car door. Such movement to the position shown in FIGS. 5 and 6 first retracts lock 99, 101 from keeper 103, and during retraction of the lock moves pivot member 111*a* on upper travel bar 89 to the front end of lost-motion slot 113*a* in shaft opening actuating link 105*a* without rotating shaft 41 until lock 99, 101 has cleared keeper 103. Simultaneously pinhead cam 97 has moved forward the same amount, but remains unelevated by passing to the inner side of cam lever 98 which is held in outward position by arm 104 on shaft 41.

Further forward movement of the gear box and of travel bars 81 and 89, which are still locked together by pin 95, causes pivot member 111*a* to pull link 105*a* forward to the position shown in FIGS. 10 and 11 in which link 105*a* has rotated shaft 41 and cranks 47 and 55 about 90° counterclockwise, thereby moving the rear edge of door 13 out of the door opening 5, 7, 9, 11 and, through engagement of bracket 121 with the rear surface of the front end of lever 98, the rear end of the latter is swung inwardly to overlie the sloping upper surface of cam 97. During the forward movement of bars 81 and 89, the bottom travel bar caused no movement of shaft closing actuating link 105*b* because pivoted connector 111*b* moved initially from the rear end of lost-motion slot 113*b* to a point intermediate the ends of the slot, and during counterclockwise rotation of shaft 41, shaft 105*b* followed the movement of the shaft as slot 113*b* moved on connector 111*b* until the latter reached the front end of the slot 113*b* as seen in FIGS. 10 and 11. Further forward movement of the travel bars 81 and 89, and corresponding clockwise movement of handwheel 63, is prevented by the engagement of the rear end of recess 91 in upper travel bar 89 with shaft 41.

Handwheel 63 is then rotated counterclockwise until the parts assume the position shown in FIGS. 12 and 13 to pull travel bars 81 and 89 (still locked together by pin 95) rearwardly with the front ends of recesses 87 and 91 in both travel bars engaging shaft 41, such movement being accomplished without further rotation of shaft 41 because of lost-motion slots 113*a* and 113*b* in the respective shaft opening and closing actuating links 105*a* and 105*b*. After the parts reach the position shown in FIGS. 12 and 13, counterclockwise rotation of the handwheel is continued, pulling bar 81 and with it door 13 rearwardly until the door is fully clear of the opening in the car wall.

The parts remain in the position shown in FIGS. 12 and 13 until closing movement is initiated, by rotating handwheel 63 clockwise. Initial clockwise rotation of the handwheel pushes both travel bars 81 and 89 forward until lock 99, 101 is fully retracted and locking pinhead cam 97 reaches the end of inwardly positioned cam lever 98, which the sloping bottom surface of cam 97 overrides as shown in FIGS. 14 and 15, lifting pin 95 out of hole 94 in bottom travel bar 81 and permitting the latter to travel forward without further forward movement of upper travel bar 89.

Clockwise rotation of handwheel 63 is continued, causing lower travel bar 81 to continue its forward movement, causing forward movement of the door until the front edge of the door enters the door opening and abuts front edge 7 thereof, whereupon further clockwise rotation of the handwheel causes further forward movement of lower travel bar 81 relative to the door and causes pivoted connector 111*b* to engage the front end of lost-motion slot 113*b* in closing actuating link 105*b*, thereby pulling link 105*b* forward and causing it to rotate shaft 41 clockwise until cranks 47 and 55 are parallel to the car side and the rear margin of the door is flush with the car side wall and causing bracket 104 on the shaft to push the front end of cam lever 98 inwardly and thereby move the rear end of the cam lever outwardly sufficient to free pinhead cam 97.

Handwheel 63 is then rotated counterclockwise, pulling bar 81 rearwardly until hole 94 is in registry with locking pin 97, freed from cam lever 98 as described above. When this occurs, locking pin 97 drops into hole 94 in lower travel bar 81, so that further rearward movement of lower travel bar 81 causes corresponding movement of upper travel bar 89 and projection of lock 99, 101 into its keeper 103 on the car side wall adjacent the rear edge 5 of the door opening.

The details of the mechanism may be varied substantially without departing from the spirit of the invention and the exclusive use of such modifications as come within the scope of the appended claims is contemplated.

I claim:

1. In combination, a wall having a door opening, a plug door for said opening, means mounting said door for movement transversely of the wall between positions within and outside of said opening and longitudinally of the wall out of and into longitudinal registry with said opening, said mounting means including a track mounted on the wall in parallel relation therewith, a carriage riding on said track, an upright shaft rotatably journaled on the door and having a crank pivotally mounted on said carriage and rotatable between a door closed position generally parallel and a door open position angular with respect to said wall, operating means comprising first and second parallel bars mounted on said door for movement lengthwise thereof, said first bar being selectively movable, means normally interconnecting said bars to cause them to move in unison, a first lost-motion link pivotally connected to said first bar and to said shaft for causing said shaft to rotate in a door closing direction when said first bar is moved forwardly with respect to said door a predetermined distance and for leaving said shaft motionless when said first bar is moved rearwardly with respect to said door, a second lost-motion link pivotally connected to said second bar and to said shaft for causing said shaft to rotate in a door opening direction when said second bar is moved forwardly with respect to the door and for leaving said shaft motionless when said second bar is moved rearwardly, and means responsive to rotation of said shaft to door-fully-open position for disengaging said interconnecting means and thereby permitting movement of said first bar to its predetermined door closing position without causing corresponding forward movement of said second bar and consequent further rotation of said shaft, said operating means being engageable with said shaft to move said door along said track between positions in and out of longitudinal registry with said door opening when said shaft is in the door-fully-open position.

2. The combination according to claim 1 including a keeper on said wall adjacent the door opening therein, a locking member slidable lengthwise of said door between a retracted unlocking position and a projected locking position extending into said keeper, said operating means being operatively connected to said locking member to effect its retraction and projection, the operative connections of said operating means to said shaft being arranged to avoid rotation of said shaft in either direction while said locking member is projected.

3. The combination according to claim 1 wherein said disengaging means is responsive to movement of said first bar and said shaft to the door fully-closed position to permit reengagement of said interconnecting means upon predetermined rearward movement of said first bar.

4. The combination according to claim 3 wherein said wall is provided with a keeper element adjacent the rear edge of the door opening therein and said second bar is formed with a locking member projecting from the rear edge of the door when said second bar is in its rearmost position, said locking member being lockably receivable in said keeper when the door is positioned within the door opening and being retractable forwardly to the rear edge of the door during movements of the door transversely of the wall.

5. The combination according to claim 4 wherein said lost-motion links are connected to the respective bars forwardly of said upright shaft and to opposite sides of said shaft whereby to operate in tension to perform their respective functions.

6. The combination according to claim 5 wherein said travel bars are formed with longitudinally spaced rearwardly and forwardly facing shoulders engageable respectively with the front and rear sides of said shaft when said door is positioned transversely outwardly of said opening, for moving said door forwardly toward registry with said opening responsive to forward movement of said first travel bar and rearwardly out of registry with said door opening responsive to rearward movement of said travel bars.

7. The combination according to claim 6 wherein said interconnecting means comprises a pair of normally vertically aligned holes in said bars and a vertically slidable pin carried by the upper of said travel bars.

8. The combination according to claim 7 wherein said pin has an enlarged head normally positioned in spaced relation above the upper of said bars, and said disengaging means comprises a lever fulcrumed to the door on a vertical axis, a first arm on said shaft engageable with said lever to move the latter out of the path of said pin head when the shaft rotates to the door closed position so as to permit said pin to drop into the hole in the lower of said bars when said holes are aligned by rearward movement of said first bar to fully-closed position whereby to cause said second bar to move rearwardly and causes engagement of said locking member and said keeper element, and a second arm on said shaft engageable with said lever to move the latter into the path of said pin head when said shaft rotates to the door-open position so that forward movement of said bars thereafter causes said lever to underlyingly engage said pin head and raise the pin out of engagement with the aligned hole in the bottom bar, permitting the latter to continue its forward movement and, through said first lost-motion link, cause door-closing rotation of said shaft without corresponding forward motion of said second bar.

9. The combination according to claim 8 wherein said pin head is formed as a cam, the top surface of which curves gradually downwardly from its inboard to its outboard side and from its rear end toward its front end and with its bottom surface curving gradually upwardly toward its front end, and the top of said lever is curved gradually downwardly and from front to rear and the inboard side of said lever is outwardly tapered and its bottom surface arcuately recesses near its rear end to facilitate coaction with the cooperating surfaces of said pin head cam clearing the same when said lever is swung outwardly by said shaft and underlyingly engaging the cam when said lever is in its inboard position.

10. The combination according to claim 1 including actuating means mounted on said wall for selective movements in directions lengthwise thereof and means pivotally connecting said actuating means to said operating means.

11. The combination according to claim 10 wherein said actuating means comprises a rack mounted on said wall, a gear box slidably mounted on said rack, a pinion journaled in said gear box and engaging said rack, means for selectively rotating said pinion, and link means connecting said gear box to said operating means.

12. The combination according to claim 1 wherein the front end of said track bends inwardly toward said wall, said shaft being journaled on the rear portion of said door, and a second carriage being pivoted directly to the front portion of said door and resting on the front inwardly-bent end of said track when the door is closed.

* * * * *

UNITED STATES PATENT OFFICE

CERTIFICATE OF CORRECTION

Patent No. 3,990,184 Dated November 9, 1976

Inventor(s) Luther L. Bollinger

It is certified that error appears in the above-identified patent and that said Letters Patent are hereby corrected as shown below:

Column 3, line 43, "gearing" should read --gear 67--.

Column 4, line 47, "counter-" should be cancelled.

Column 5, line 43, "clockwise" should read --counterclockwise--;
line 57, "counterclockwise" should read --clockwise--.

Column 6, line 11, "counterclockwise" should read --clockwise--;
line 29, "clockwise" should read "counterclockwise--.

Figure 1 and the drawing figure which appear on the cover sheet should appear as per attachment.

Signed and Sealed this

*Twentieth* Day of *September 1977*

[SEAL]

*Attest:*

RUTH C. MASON
*Attesting Officer*

LUTRELLE F. PARKER
*Acting Commissioner of Patents and Trademarks*